US008480214B2

(12) United States Patent
Tsubaki

(10) Patent No.: US 8,480,214 B2
(45) Date of Patent: Jul. 9, 2013

(54) LIQUID JETTING HEAD UNIT AND IMAGE FORMING APPARATUS

(75) Inventor: Kengo Tsubaki, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 13/005,660

(22) Filed: Jan. 13, 2011

(65) Prior Publication Data

US 2011/0181670 A1 Jul. 28, 2011

(30) Foreign Application Priority Data

Jan. 22, 2010 (JP) ..... 2010-012227

(51) Int. Cl.
*B41J 2/175* (2006.01)

(52) U.S. Cl.
USPC ..... 347/85; 347/42; 347/89; 347/93; 347/92; 210/112; 210/329; 210/87

(58) Field of Classification Search
None
See application file for complete search history.

(56) References Cited

U.S. PATENT DOCUMENTS 5,818,485 A * 10/1998 Rezanka ..... 347/89
6,116,727 A * 9/2000 Hagiwara ..... 347/89
7,828,425 B2 * 11/2010 Kang et al. ..... 347/93
2004/0085416 A1 * 5/2004 Kent ..... 347/89
2005/0219315 A1 * 10/2005 Hori ..... 347/42
2007/0188564 A1 8/2007 Harvey et al.
2008/0024553 A1 * 1/2008 Morgan et al. ..... 347/42
2010/0201759 A1 * 8/2010 Kawase et al. ..... 347/85
2010/0289856 A1 11/2010 Yamamoto et al.
2011/0128335 A1 6/2011 von Essen et al.

FOREIGN PATENT DOCUMENTS

JP 2006-168023 6/2006
JP 4071156 1/2008
JP 2008-30333 2/2008
JP 2009-126044 6/2009
WO WO2005/007415 A2 1/2005
WO WO2009/066612 A1 5/2009
WO WO2009/142889 A1 11/2009

OTHER PUBLICATIONS

Mar. 29, 2012 European search report in connection with counterpart European patent application No. 11 15 0263.

* cited by examiner

*Primary Examiner* — Matthew Luu
*Assistant Examiner* — John P Zimmermann
(74) *Attorney, Agent, or Firm* — Cooper & Dunham LLP

(57) ABSTRACT

In a liquid jetting head unit, a tank case in a head tank includes a first connection path connecting a downstream chamber of the tank case and a discharge path, and a second connection path connecting an upstream chamber of the tank case and the discharge path. The discharge path includes a filter member provided between a first part of the discharge path connected to the first connection path and a second part of the discharge path connected to the second connection path.

12 Claims, 13 Drawing Sheets

LIQUID JETTING HEAD UNIT AND IMAGE FORMING APPARATUS

BACKGROUND OF THE INVENTION

1. Field of the Invention

The present invention relates to a liquid jetting head unit and an image forming apparatus.

2. Description of the Related Art

There are image forming apparatuses such as printers, fax machines, copiers, plotters, and multifunction peripherals including functions of these devices. An inkjet recording apparatus is known as an example of an image forming apparatus of a liquid jet recording method using recording heads configured with liquid jetting heads (liquid droplet jetting heads) for jetting ink droplets. Such an image forming apparatus of a liquid jet recording method forms images (record and print may be used synonymously as form) by jetting ink droplets from recording heads onto a conveyed sheet (the sheet is not limited to a paper sheet; the sheet may be any sheet onto which ink droplets or other types of liquid can adhere such as an OHP transparency film; the sheet may also be referred to as a recording medium, a recording sheet, etc.). There are several types of image forming apparatuses of a liquid jet recording method. One example is a serial type image forming apparatus that forms images by jetting liquid droplets while moving the recording heads in a main scanning direction. Another example is a line type image forming apparatus that uses line type heads to form images by jetting liquid droplets while the recording heads do not move.

In the present application, an image forming apparatus of a liquid jet recording method means an apparatus that forms images by jetting liquid onto a medium such as paper, thread, fiber, cloth, leather, metal, plastic, glass, wood, ceramics, etc. Forming images on a medium means forming images having meaning (such as characters and figures) and forming images without any meaning (such as patterns, e.g., merely jetting liquid droplets onto a medium). Ink is not limited to what is generally referred to as ink; ink refers to any kind of liquid that can be used for forming images, such as recording liquid and fixing process liquid; examples of ink are DNA samples, resist, and pattern material. Furthermore, an image is not limited to a planar image, an image may be formed on a three-dimensional object, or a three-dimensional object may be formed.

In an image forming apparatus of a liquid jet recording method, when air bubbles are mixed in the liquid jetting head, the droplet jetting direction may change or droplet jetting failures may occur. Therefore, it is necessary to efficiently discharge the air bubbles that have been mixed in the ink supply path.

Conventionally, there is a technology for discharging air bubbles in a head tank (a tank directly provided in the head; may also be synonymously referred to as a sub tank or a buffer tank). For example, a recording head is equipped with a first ink chamber having an indraft port for intaking ink from an ink supply source, a second ink chamber to which the ink is supplied from the first ink chamber, an outlet port for jetting the ink of the second ink chamber to perform recording, a first exhaust port for exhausting the liquid from the first ink chamber, a second exhaust port for exhausting the liquid from the second ink chamber, and a gas-liquid separation means for regulating the exhausting of the liquid, which is installed at least in one of the spaces between the first ink chamber and the first exhaust port, and between the second ink chamber and the second exhaust port. The fluid resistance between the indraft port and the first exhaust port is smaller than the fluid resistance between the indraft port and the second exhaust port (see patent document 1).

In another example of a recording head, the top face of a flat first space extending along the filter longitudinal direction which is a space in the upstream of the filter of a filter chamber, is formed as a slope which inclines downward from one side of the direction of a nozzle row toward the other end side, namely toward the side corresponding to the exhaust port from a feed port side. The bubble exhaust port that is facing the first space and that is used as a bubble exhaust path for exhausting bubbles, is provided at a position corresponding to the upper part on the side opposite to the exhaust port through the filter (see patent document 2).

In yet another example, an image forming apparatus includes a first ink flow-in port, a second ink flow-in port and a third ink flow-in/out port communicating with a common liquid chamber. An opening/closing valve which blocks a passage connecting a sub tank and the first ink flow-in port is provided. In a printing mode, the ink is fed to the recording head from the sub tank through the first ink flow-in port or through the first ink flow-in port as well as an ink flow-in/out port. In an ink circulation mode, the ink is fed to the recording head from the sub tank through the second ink flow-in port by closing the opening/closing valve, and the ink which flows out from the recording head is collected in the sub tank through the ink flow-in/out port (see patent document 3).

Patent Document 1: Japanese Laid-Open Patent Application No. 2009-126044

Patent Document 2: Japanese Laid-Open Patent Application No. 2008-030333

Patent Document 3: Japanese Laid-Open Patent Application No. 2006-168023

For example, a line-type image forming apparatus includes a recording head unit having a width extending across the entire width of a recording medium. In the recording head unit, plural liquid jetting head units are aligned. Each liquid jetting head unit is formed by integrally combining a head and a tank for supplying liquid to the head (head tank). Ink is supplied from the main tank to the head tanks through a sub tank and distributors for distributing ink to the heads. The head tanks include filter members for filtering impurities mixed in the ink.

However, the nozzle of the head is extremely fine (for example, $\phi 24$ μm). Therefore, if the ink includes a large amount of dissolved oxygen, oxygen gradually accumulates in the head, which leads to ink jetting failures. If air bubbles are mixed in the ink in the ink supply path including the head tank, the ink with air bubbles is distributed to the head, and the amount of dissolved oxygen in the ink increases. Consequently, the head may not be able to jet a predetermined amount of liquid droplets, or the head may not be able jet any liquid droplets at all. Thus, it is necessary to remove the air bubbles from the ink.

As described above, if air bubbles are generated in the head tank and the air bubbles are mixed into the head, liquid droplets may not be properly jetted from the head.

SUMMARY OF THE INVENTION

The present invention provides a liquid jetting head unit and an image forming apparatus in which one or more of the above-described disadvantages are eliminated.

A preferred embodiment of the present invention provides a liquid jetting head unit and an image forming apparatus capable of reducing air bubbles that are mixed into the head from the head tank.

According to an aspect of the present invention, there is provided a liquid jetting head unit including a head that jets liquid droplets; and a liquid storing tank that stores liquid to be supplied to the head, the liquid storing tank being integrally combined with the head, wherein the head includes a common flow path from which the liquid is supplied to plural liquid chambers connected to plural nozzles that jet the liquid droplets, and the common flow path includes a supply port through which the liquid is supplied into the common flow path and a discharge port through which the liquid is discharged outside, wherein the liquid storing tank includes a storage unit that stores the liquid to be supplied to the head, the storage unit being divided into an upstream chamber and a downstream chamber by a filter member, a supply path through which the liquid is supplied to the supply port of the head from the downstream chamber of the storage unit, a discharge path through which the liquid discharged from the discharge port of the head is discharged outside, and a first connection path connecting the downstream chamber and the discharge path.

According to an aspect of the present invention, there is provided a liquid jetting head unit including a head that jets liquid droplets; and a liquid storing tank that stores liquid to be supplied to the head, the liquid storing tank being integrally combined with the head, wherein the head includes a common flow path from which the liquid is supplied to plural liquid chambers connected to plural nozzles that jet the liquid droplets, and the common flow path includes a supply port through which the liquid is supplied into the common flow path and a discharge port through which the liquid is discharged outside, wherein the liquid storing tank includes a storage unit that stores the liquid to be supplied to the head, the storage unit being divided into an upstream chamber and a downstream chamber by a filter member, a supply path through which the liquid is supplied to the supply port of the head from the downstream chamber of the storage unit, a discharge path through which the liquid discharged from the discharge port of the head is discharged outside, and a second connection path connecting the upstream chamber and the discharge path, wherein the discharge path includes a filter member or a check valve positioned on an upstream side of a connection part in a liquid discharge direction, the connection part being where the discharge path is connected to the second connection path.

According to an aspect of the present invention, there is provided a liquid jetting head unit including a head that jets liquid droplets; and a liquid storing tank that stores liquid to be supplied to the head, the liquid storing tank being integrally combined with the head, wherein the head includes a common flow path from which the liquid is supplied to plural liquid chambers connected to plural nozzles that jet the liquid droplets, and the common flow path includes a supply port through which the liquid is supplied into the common flow path and a discharge port through which the liquid is discharged outside, wherein the liquid storing tank includes a storage unit that stores the liquid to be supplied to the head, the storage unit being divided into an upstream chamber and a downstream chamber by a filter member, a supply path through which the liquid is supplied to the supply port of the head from the downstream chamber of the storage unit, a discharge path through which the liquid discharged from the discharge port of the head is discharged outside, a first connection path connecting the downstream chamber and the discharge path, and a second connection path connecting the upstream chamber and the discharge path, wherein the discharge path includes a filter member or a check valve positioned in between a first connection part and a second connection part, the first connection part being where the discharge path is connected to the first connection path and the second connection part being where the discharge path is connected to the second connection path.

According to one embodiment of the present invention, a liquid jetting head unit and an image forming apparatus are provided, with which air bubbles that are mixed into the head from the head tank can be reduced, and images can be formed by stably jetting liquid droplets.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
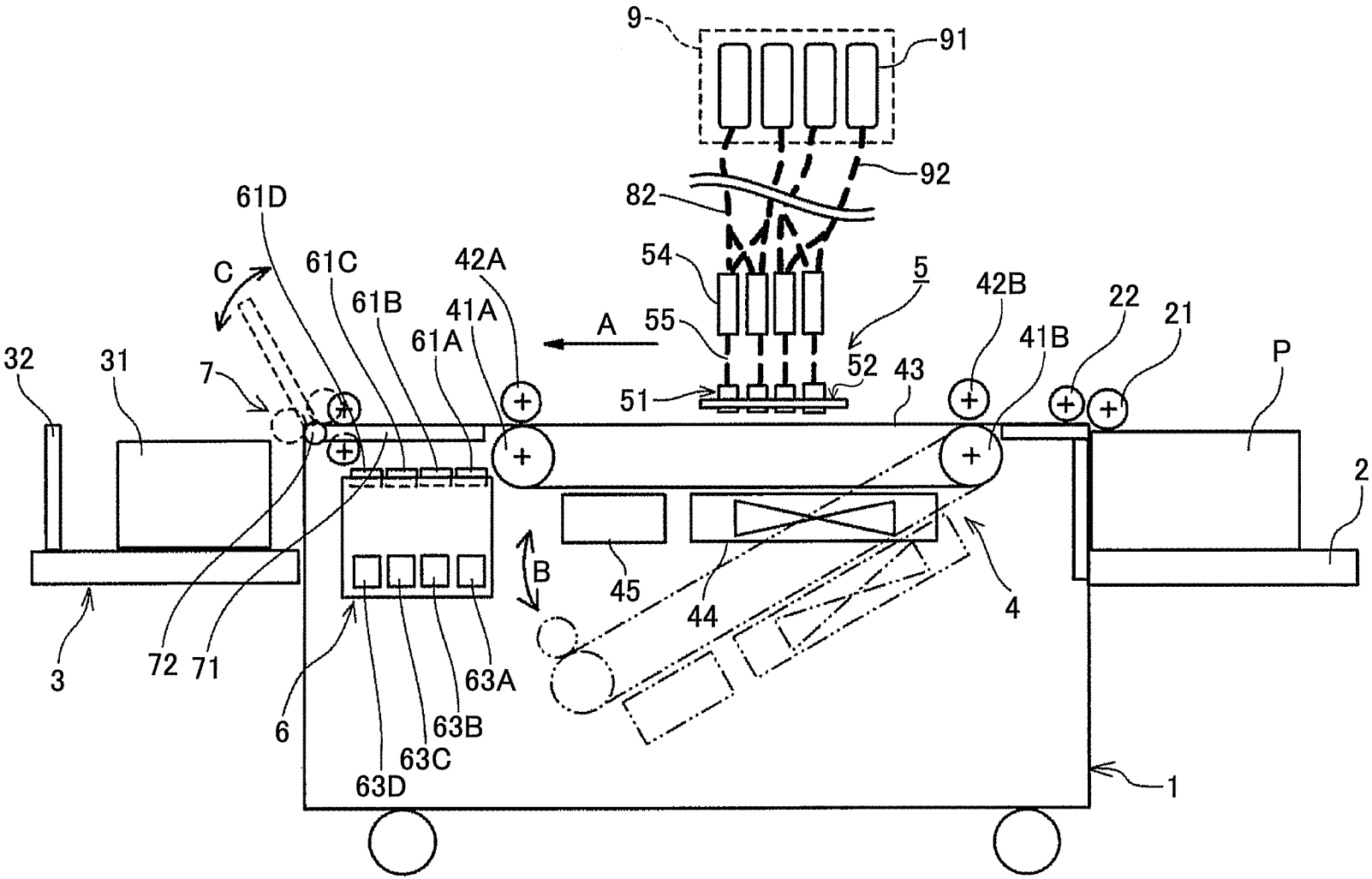
FIG. 1 is a schematic diagram of the entire configuration of an image forming apparatus.
Figure 2:
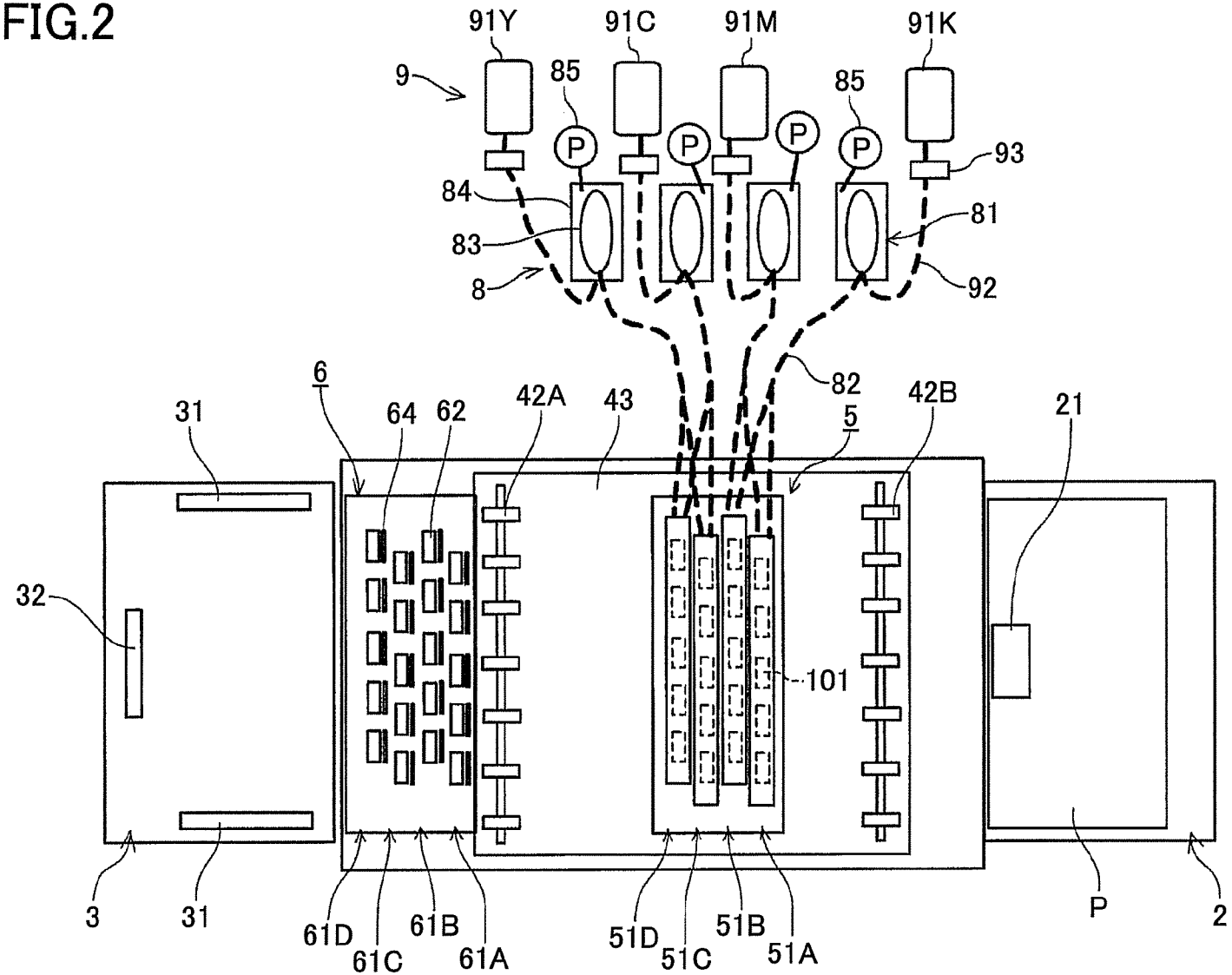
FIG. 2 is a schematic planar view of relevant parts of the image forming apparatus.

A description is given of an image forming apparatus including a liquid jetting head unit according to an embodiment of the present invention, with reference to FIGS. 1 and 2. FIG. 1 is a schematic diagram of the entire configuration of the image forming apparatus, and FIG. 2 is a schematic plan view of relevant parts of the image forming apparatus.

The image forming apparatus is a line type image forming apparatus, including a main unit 1, a sheet feeding tray 2 for stacking/feeding sheets P, a sheet eject tray 3 to which sheets P on which images have been printed are ejected/stacked, a conveying unit 4 for conveying the sheet P from the sheet feeding tray 2 to the sheet eject tray 3, an image forming unit 5 including head modules 51 configuring recording heads for performing printing by jetting liquid droplets onto a sheet P conveyed by the conveying unit 4, a head cleaning device 6 that is a maintenance recovery mechanism for performing mechanism/recovery for the recording heads in the image forming unit 5 after printing operations or at predetermined timings, a conveying guide unit 7 that opens and closes the head cleaning device 6, an ink tank unit 8 including sub tanks for supplying ink to the head modules 51 in the image forming unit 5, and a main tank unit 9 for supplying ink to the ink tank unit 8.

The main unit 1 includes a front plate, a back plate, and a stay (not shown). The sheets P stacked on the sheet feeding tray 2 are fed into the conveying unit 4 one by one by a separating roller 21 and a sheet feeding roller 22.

The conveying unit 4 includes a conveying driving roller 41A, a conveying subordinate roller 41B, and an endless-type conveying belt 43 that is wound around the rollers 41A and 41B. On the surface of the endless-type conveying belt 43, there are multiple suction holes (not shown). Below the endless-type conveying belt 43, a suction fan 44 is provided for suctioning the sheet P. Conveying guide rollers 42A and 42B are provided above the conveying driving roller 41A and the conveying subordinate roller 41B, respectively. The conveying guide rollers 42A and 42B are supported by guides (not shown), and are in direct contact with the endless-type conveying belt 43 by gravity.

The conveying belt 43 is circulated as the conveying driving roller 41A is rotated by a motor (not shown). The sheet P is suctioned onto the conveying belt 43 by the suction fan 44, and the sheet P is conveyed as the conveying belt 43 is circulated. The conveying subordinate roller 41B and the conveying guide rollers 42A and 42B are rotated according to the circulation of the conveying belt 43. Furthermore, under the conveying belt 43, there is provided an idle jetting cleaning device 45 that removes any liquid droplets adhering to the conveying belt 43 as a result of idle jetting.

Above the conveying unit 4, there is provided the image forming unit 5 that is movable in a direction indicated by an arrow A (and in the opposite direction). The image forming unit 5 includes the plural head modules 51 for jetting liquid droplets to print images on the sheet P. When a maintenance/recovery operation is performed (for cleaning the head modules 51), the image forming unit 5 is moved to a position above the head cleaning device 6. When image forming operations are performed, the image forming unit 5 is returned to the position as illustrated in FIG. 1.

The image forming unit 5 includes the head modules (recording head units) 51A, 51B, 51C, and 51D that are aligned along the sheet conveying direction and attached to a line base member 52. Specifically, the head modules (recording head units) 51A, 51B, 51C, and 51D include an alignment of liquid jetting head units (hereinafter, "head units" 101) according to an embodiment of the present invention, in which plural heads for jetting liquid droplets and head tanks are integrally combined.

In this example, between the two nozzle rows of the head modules 51A and 51B, yellow (Y) liquid droplets are jetted from one nozzle row and magenta (M) liquid droplets are jetted from the other nozzle row. Furthermore, between the two nozzle rows of the head modules 51C and 51D, cyan (C) liquid droplets are jetted from one nozzle row and black (K) liquid droplets are jetted from the other nozzle row. In the image forming unit 5, two head modules 51 that jet liquid droplets of the same color are arranged in the sheet conveying direction, and two head modules 51 correspond to one nozzle row extending across the width of the sheet.

Furthermore, distribution tanks 54 for supplying ink to the corresponding head units 101 are provided for corresponding head modules 51. The distribution tanks 54 and the head units 101 are connected by tubes 55. Sub tanks 81 are provided on the upstream side of the distribution tanks 54, which are connected to the distribution tanks 54 via supply tubes 82. Main tanks 91 for storing ink are provided on the upstream side of the sub tanks 81, and the main tanks 91 are connected to the sub tanks 81 via supply tubes 92 acting as supply paths.

The conveying guide unit 7 for ejecting the sheets P to the sheet eject tray 3 is provided on the downstream side of the conveying unit 4. The sheet P is guided and conveyed by the conveying guide unit 7, and ejected to the sheet eject tray 3. The sheet eject tray 3 includes a pair of side fences 31 for regulating the width direction of the sheet P and an end fence 32 for regulating the leading edge of the sheet P.

The maintenance/recovery mechanism (head cleaning device) 6 includes four rows of cleaning units 61A through 61D corresponding to the head modules 51 of the image forming unit 5. Each of the cleaning units 61 includes cap members 62 for capping nozzle surfaces corresponding to the head units 101 of the head modules 51, and wiping members (wiper members) 64 for wiping the nozzle surfaces. The respective rows of cap members 62 of the cleaning units 61 can move up and down independently of each other. Furthermore, suction pumps 63A through 63D are provided below the cleaning units 61A through 61D, respectively. The suction pumps 63A through 63D are suction units for suctioning ink from the nozzles in a state where the nozzle surfaces of the head units 101 are capped by the cap members 62.

In the image forming apparatus, after the printing operation, when ink is suctioned from the nozzles in a state where the nozzle surfaces of the head units 101 of the head modules 51 for jetting liquid droplets are capped by the cleaning units 61, or when the ink adhering to the nozzle surfaces of the head units 101 of the head modules 51 are cleaned with the wiping members 64, the following operation is performed. Specifically, as shown in FIG. 1, after the printing operation ends, the entire conveying unit 4 rotates in a direction indicated by an arrow B by pivoting on the conveying subordinate roller 41B. Accordingly, the space between the image forming unit 5 and the conveying unit 4 is increased compared to that during the image forming operation, thereby providing moving space for the image forming unit 5. A conveying guide plate 71 of the conveying guide unit 7 located above the head cleaning device 6 is turned upward in a direction indicated by an arrow C by pivoting on a fulcrum 72, so that the top part of the head cleaning device 6 is exposed.

After the conveying unit 4 and the conveying guide unit 7 have been opened (released), the image forming unit 5 moves in a sheet passing direction (the direction indicated by the arrow A), and stops above the head cleaning device 6. Then, the cleaning units 61 are elevated to start the cleaning operation (maintenance/recovery operation) for the head modules 51.

Figure 3:
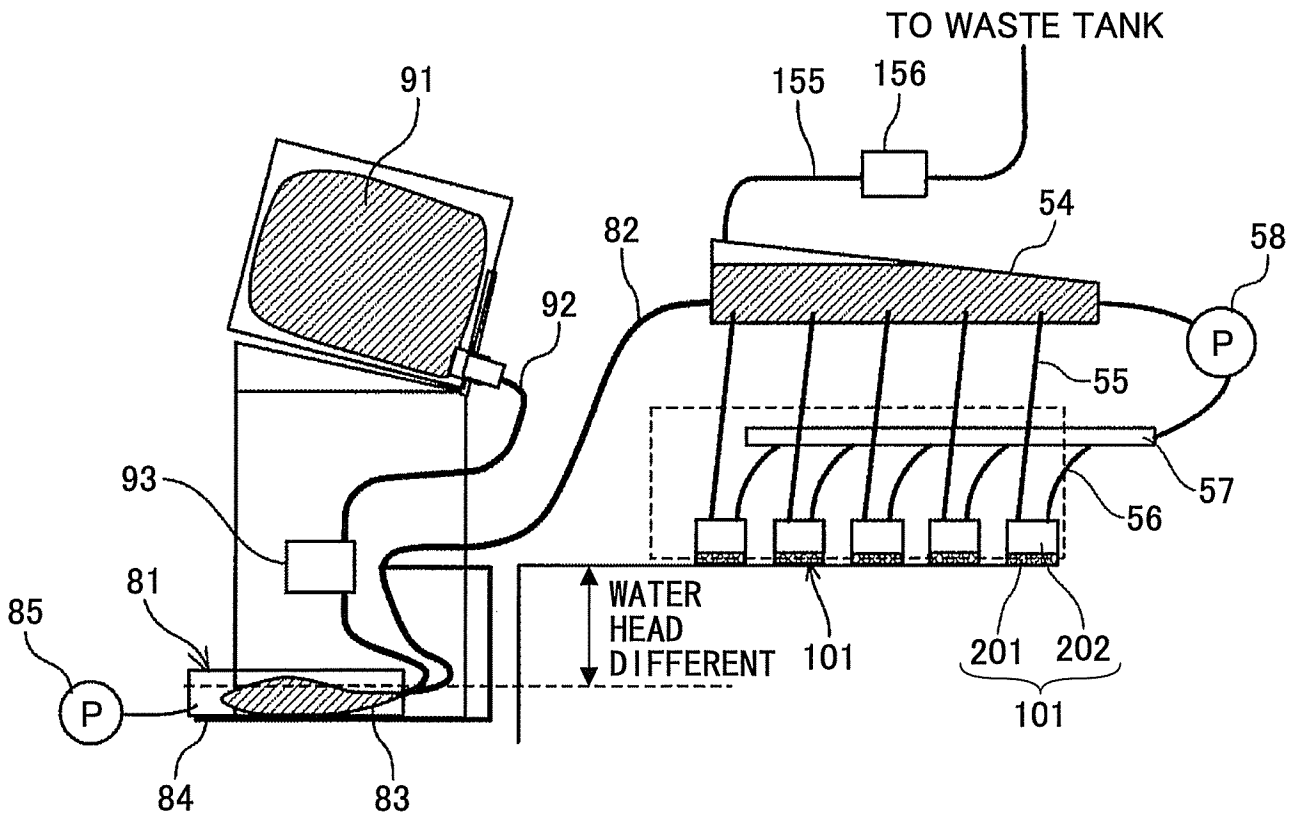
FIG. 3 is for describing an ink supply system of the image forming apparatus.
Figure 4:
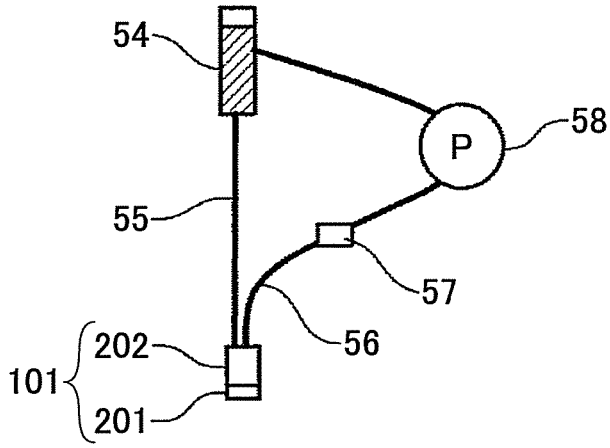
FIG. 4 is a side view of relevant parts of FIG. 3.

Next, a detailed description is given of an ink supply system including the head module 51 of the image forming apparatus, with reference to FIGS. 3 and 4.

The sub tank 81 and the distribution tank 54 of the head module 51 are connected via the supply tube 82. According to a water head difference between the sub tank 81 and the nozzle surfaces of the head units 101 (−20 mmAq through −70 mmAq), appropriate negative pressure is generated for holding the meniscuses of the nozzles of the head units 101. The head units 101 include a head 201 for jetting liquid droplets and a head tank 202 for supplying ink to the head 201, as described below.

The sub tank 81 is a package-type sub tank. Specifically, the sub tank 81 includes a flexible package 83 for storing ink accommodated in an airtight case 84. With this package-type sub tank, the ink is prevented from directly contacting the atmosphere. Accordingly, the viscosity of the ink is prevented from increasing due to moisture evaporation. Furthermore, the amount of dissolved oxygen in the ink is maintained at a predetermined level, so that air bubbles are prevented from accumulating in the head units 101.

A pressurizing pump 85 for applying pressure between the package 83 and the airtight case 84 is connected to the sub tank 81 (connected by a tube pump). Before performing a printing operation after the image forming apparatus has been left unoperated for a while, a maintenance operation is performed. The maintenance operation is performed by applying pressure in the airtight case 84 of the sub tank 81 with the pressurizing pump 85 to send the ink to the head tanks 202 of the head unit 101*s*, and then jetting the ink from the nozzles of the heads 201. The maintenance operation is performed after the image forming unit 5 has moved to the position above the head cleaning device 6.

The main tank 91 is provided on the upstream side of the sub tank 81. The main tank 91 and the sub tank 81 are connected by the supply tube 92 acting as a supply path. An electromagnetic valve 93 is provided in the supply path. The operation of opening and closing the electromagnetic valve 93 is controlled so that ink is supplied from the main tank 91 to the sub tank 81.

A tube (air discharge path) 155 and an electromagnetic valve 156 are provided above the distribution tank 54. The tube 155 is for forming an air discharge path connected to a waste tank (not shown). The electromagnetic valve 156 is for opening and closing the air discharge path 155. The electromagnetic valve 156 is opened to discharge air when the distribution tank 54 is initially filled with ink or when air bubbles have accumulated in the distribution tank 54. In order to facilitate the operation of discharging air, the top surface of the common path inside the distribution tank 54 is tilted.

The head tanks 202 of the head units 101 are connected to the distribution tank 54 by the tubes 55 for supplying ink. Furthermore, discharge tubes 56 for discharging ink are connected to the head tanks 202 of the head units 101. The discharge tubes 56 merge into one path at a circulation path 57. The circulation path 57 is connected to the distribution tank 54 via a circulation pump 58.

Figure 5:
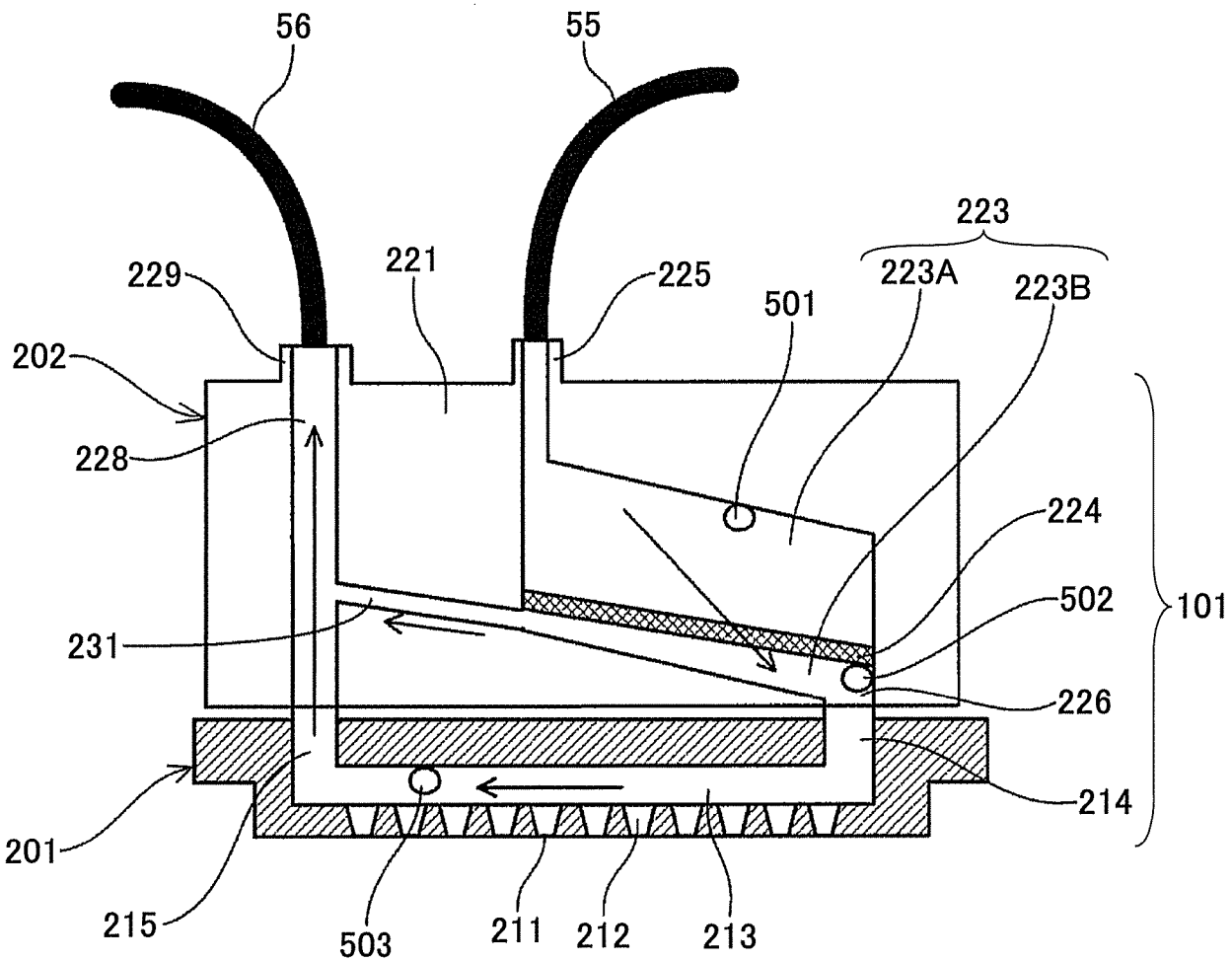
FIG. 5 is a schematic cross-sectional view of a head unit according to a first embodiment of the present invention.

Next, a detailed description is given of the head unit 101 according to a first embodiment of the present invention with reference to FIG. 5. FIG. 5 is a schematic cross-sectional view of the head unit 101.

The head unit 101 includes the head 201 for jetting liquid droplets and the head tank 202 which is a liquid storing tank according to an embodiment of the present invention for storing ink to be supplied to the head 201. The head 201 and the head tank 202 are integrally combined.

The head 201 includes plural nozzles 211 for jetting liquid droplets, liquid chambers 212 connected to the nozzles, a common liquid chamber (common flow path) 213 connected to the liquid chambers 212, an ink supply port 214 through which ink is supplied into the common liquid chamber 213, and an ink discharge port 215 through which ink is discharged from the common liquid chamber 213.

The head tank 202 is provided with a storing unit 223 for storing ink supplied into a tank case (tank main unit) 221. The storing unit 223 is provided with a filter member 224 for removing impurities from the ink. The storing unit 223 is separated into a filter upstream chamber 223A and a filter downstream chamber 223B. The filter upstream chamber 223A is connected to an ink supply port 225 that is connected to the ink supply tube 55. The filter downstream chamber 223B is connected to an ink supply path 226 that is connected to the ink supply port 214 of the head 201.

The tank case 221 includes a discharge path 228 connected to the ink discharge port 215 of the head 201. Ink is discharged into the discharge path 228 through the ink discharge port 215. The discharge path 228 is connected to an ink discharge port 229 to which the discharge tube 56 is connected.

The tank case 221 includes a first connection path 231 acting as an air bubble discharge path that connects the filter downstream chamber 223B and the discharge path 228. The first connection path 231 is shaped so as to have a fluid resistance that is higher than that of the common liquid chamber 213 of the head 201 and that of the ink supply path 226. For example, the ink supply path 226 has a diameter of 2 mm and a length of 2 mm, whereas the first connection path 231 of the filter downstream chamber 223B has a diameter of 1 mm and a length of 20 mm.

Figure 6:
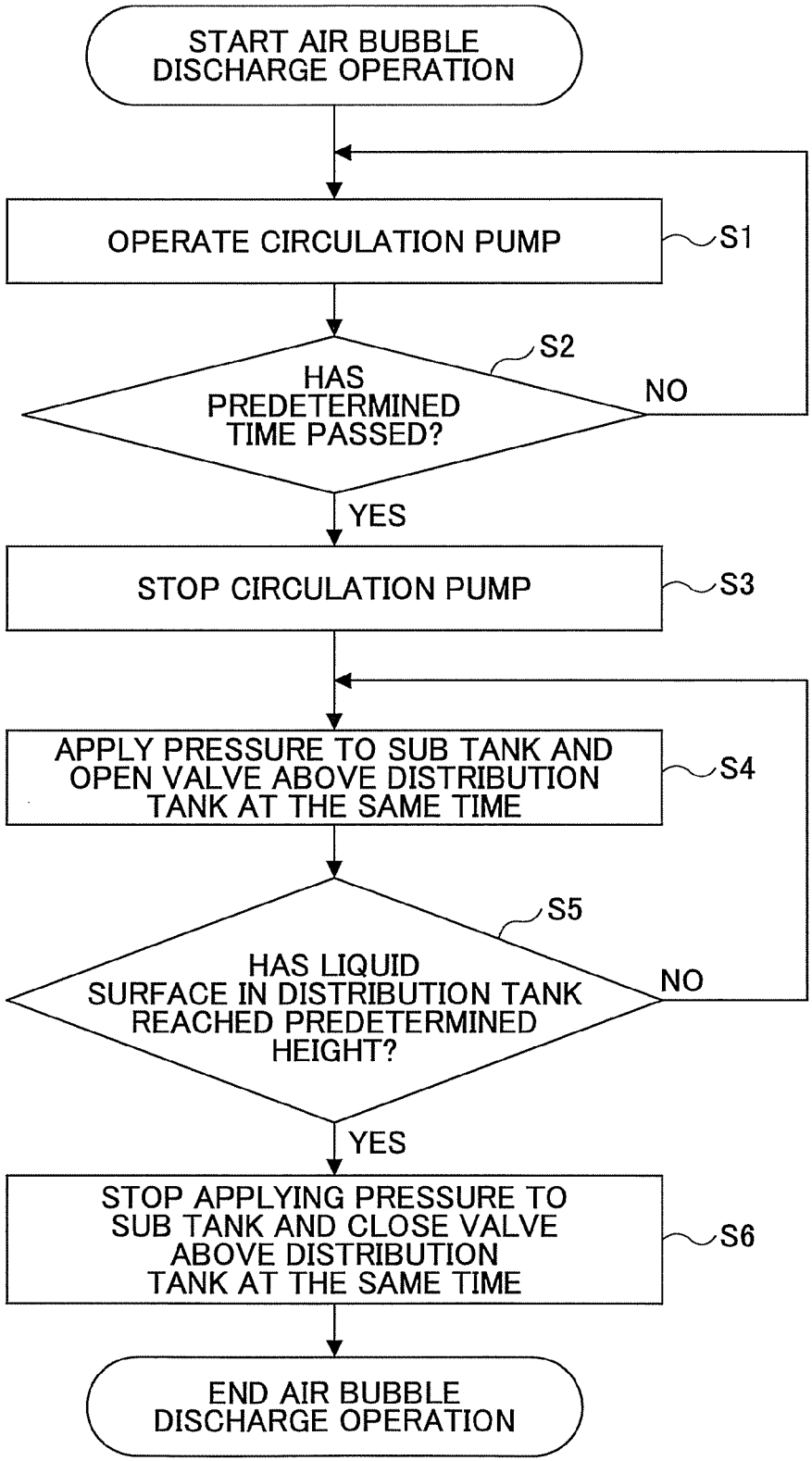
FIG. 6 is a flowchart for describing an air bubble discharge operation.

A description is given of an air bubble discharge operation to the head units 101, with reference to a flowchart shown in FIG. 6.

First, the circulation pump 58 is operated (step S1), to generate a flow flowing in the following order: distribution tank 54→head tank 202→circulation path 57→distribution tank 54. Then, air bubbles gradually accumulate at the top of the distribution tank 54, so that a large space of air is formed. The circulation pump 58 is operated for a predetermined length of time (for example, 10 seconds to 30 seconds) (Yes in step S2), and then the circulation pump 58 is stopped (step S3). Then, pressure is applied to the sub tank 81 so that ink is supplied from the sub tank 81, and the electromagnetic valve 156 above the distribution tank 54 is opened, to release the air in the atmosphere (step S4). A liquid surface detecting sensor (not shown) is provided above the distribution tank 54. When the liquid surface detecting sensor detects that the liquid surface has reached a predetermined height (Yes in step S5), the operation of applying pressure to the sub tank 81 is stopped, and the electromagnetic valve 156 above the distribution tank 54 is closed (step S6). According to the above operations, the air bubbles in the supply paths and the head tank 202 are discharged.

Next, a description is given of the operation of discharging the air bubbles in the head units 101.

It is assumed that an air bubble 501 has entered the filter upstream chamber 223A of the head tank 202, an air bubble 502 has entered the filter downstream chamber 223B of the head tank 202, and an air bubble 503 has entered the common liquid chamber 213 of the head 201. In this case, by performing above circulation operation for discharging air bubbles, the air bubble 503 in the common liquid chamber 213 can be easily discharged. Furthermore, the air bubble 502 in the filter downstream chamber 223B below the filter member 224 can also be discharged from the first connection path 231 and through the discharge path 228.

Figure 7:
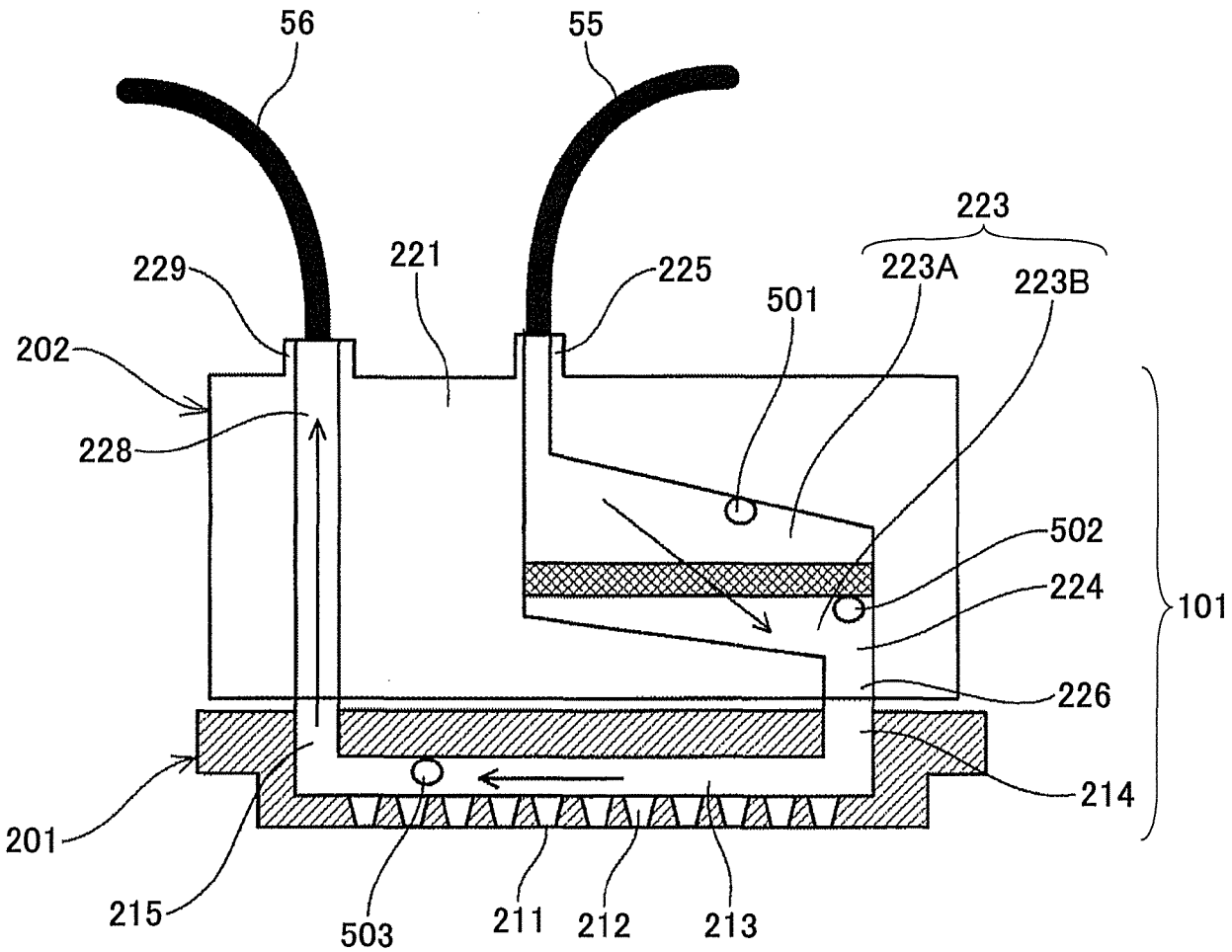
FIG. 7 is a schematic cross-sectional view of a head unit according to a comparative example.

In a head unit according to a comparative example shown in FIG. 7, when the above-described circulation operation is performed in an attempt to discharge the air bubbles 501 through 503, the air bubble 503 in the common liquid chamber 213 can be easily discharged, but the other air bubbles cannot be discharged. The air bubble 501 cannot pass through the filter member 224 unless there is more than a predetermined level of pressure. The air bubble 502 needs to flow downward, and therefore the flow rate needs to be greater than a predetermined level. If the performance of the circulation pump 58 is enhanced in attempt to meet the above requirements, air may be suctioned through the nozzles.

By providing the first connection path 231 that connects the filter downstream chamber 223B and the discharge path 228 of the head tank 202 as in the present embodiment, air bubbles in the filter downstream chamber 223B of the head tank 202 can be discharged, and air bubbles can be prevented from entering the head 201 from the head tank 202.

Figure 8:
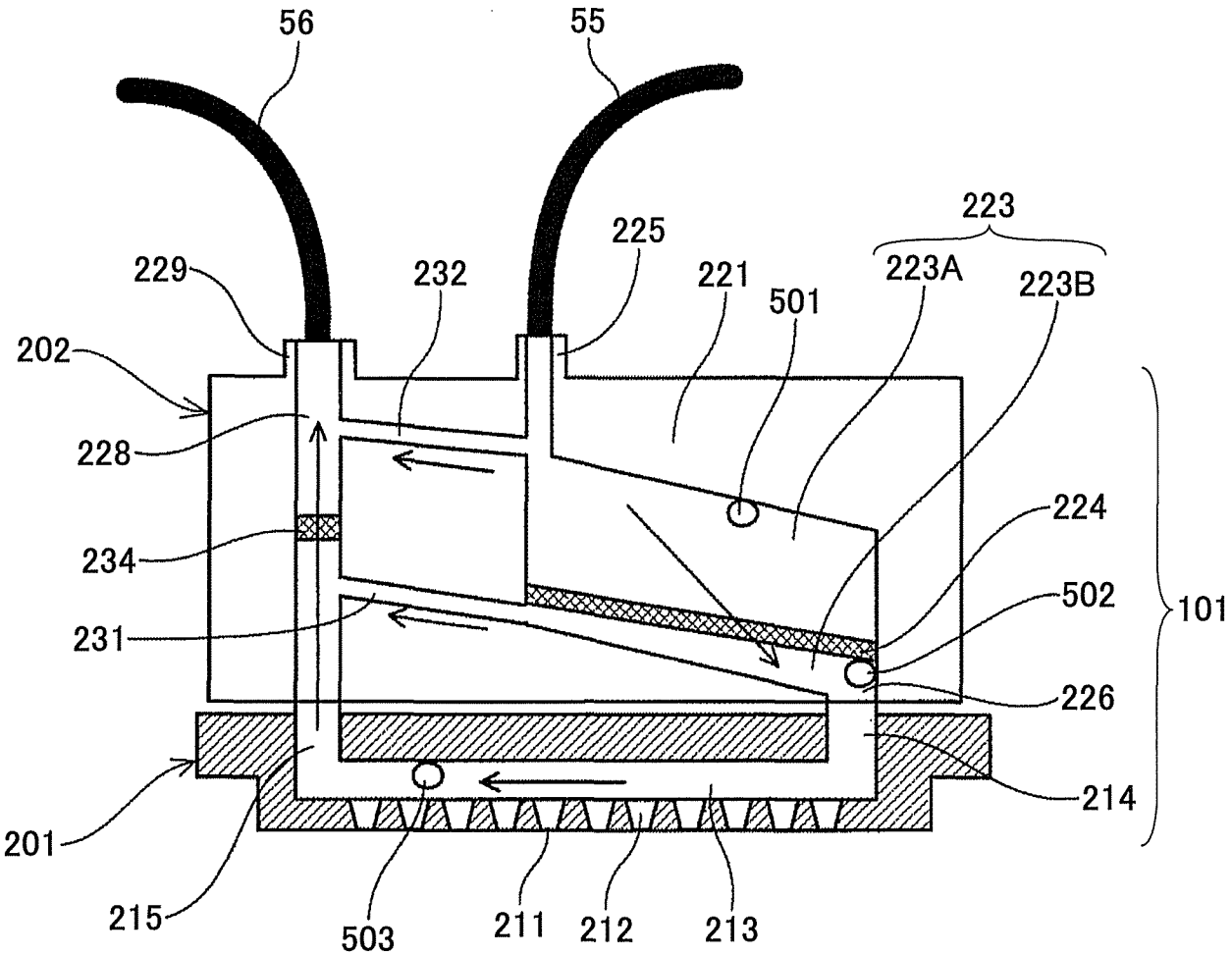
FIG. 8 is a schematic cross-sectional view of a head unit according to a second embodiment of the present invention.

Next, a detailed description is given of the head unit 101 according to a second embodiment of the present invention with reference to FIG. 8. FIG. 8 is a schematic cross-sectional view of the head unit 101 according to the second embodiment.

As shown in FIG. 8, the tank case 221 of the head tank 202 includes the first connection path 231 acting as an air bubble discharge path connecting the filter downstream chamber 223B and the discharge path 228. Furthermore, the tank case 221 of the head tank 202 includes a second connection path 232 acting as an air bubble discharge path connecting the filter upstream chamber 223A and the discharge path 228. Furthermore, a filter member 234 is provided between the part of the discharge path 228 connected to the first connection path 231 and the part of the discharge path 228 connected to the second connection path 232.

The first connection path 231 and the second connection path 232 are shaped so as to have a fluid resistance that is higher than that of the common liquid chamber 213 of the head 201 and that of the ink supply path 226. For example, the ink supply path 226 has a diameter of 2 mm and a length of 2 mm, whereas the first connection path 231 of the filter downstream chamber 223B and the second connection path 232 of the filter upstream chamber 223A have a diameter of 1 mm and a length of 20 mm.

According to the above configuration, by performing the circulation operation to discharge air bubbles, the following effects can be achieved in addition to those of the first embodiment. Specifically, the air bubble 501 in the filter upstream chamber 223A above the filter member 224 can be discharged from the second connection path 232 and through the discharge path 228. In this case, the discharge path 228 is relatively narrow, and therefore the flow rate and the pressure increase in the discharge path 228. Thus, during the circulation operation, the air bubbles 502 and 503 move under the filter member 234 and pass through the filter member 234 with the assistance of the buoyancy that causes the air bubbles 502 and 503 to rise.

When ink is jetted from the head unit 101 in a regular jetting operation, the ink passes through a regular supply path (tank supply port 225→filter member 224→ink supply port 214 of head 201→common liquid chamber 213). A slight amount of ink also passes through a path extending from the filter upstream chamber 223A of the filter member 224 to the second connection path 232 (tank supply port 225→second connection path 232→discharge path 228→ink discharge port 215→common liquid chamber 213). However, the filter member 234 is provided in the discharge path 228 on the upstream side in the discharge direction close to the second connection path 232. Therefore, it is possible to filter the slight amount of ink entering the common liquid chamber 213 from the filter upstream chamber 223A through the second connection path 232.

Figure 9:
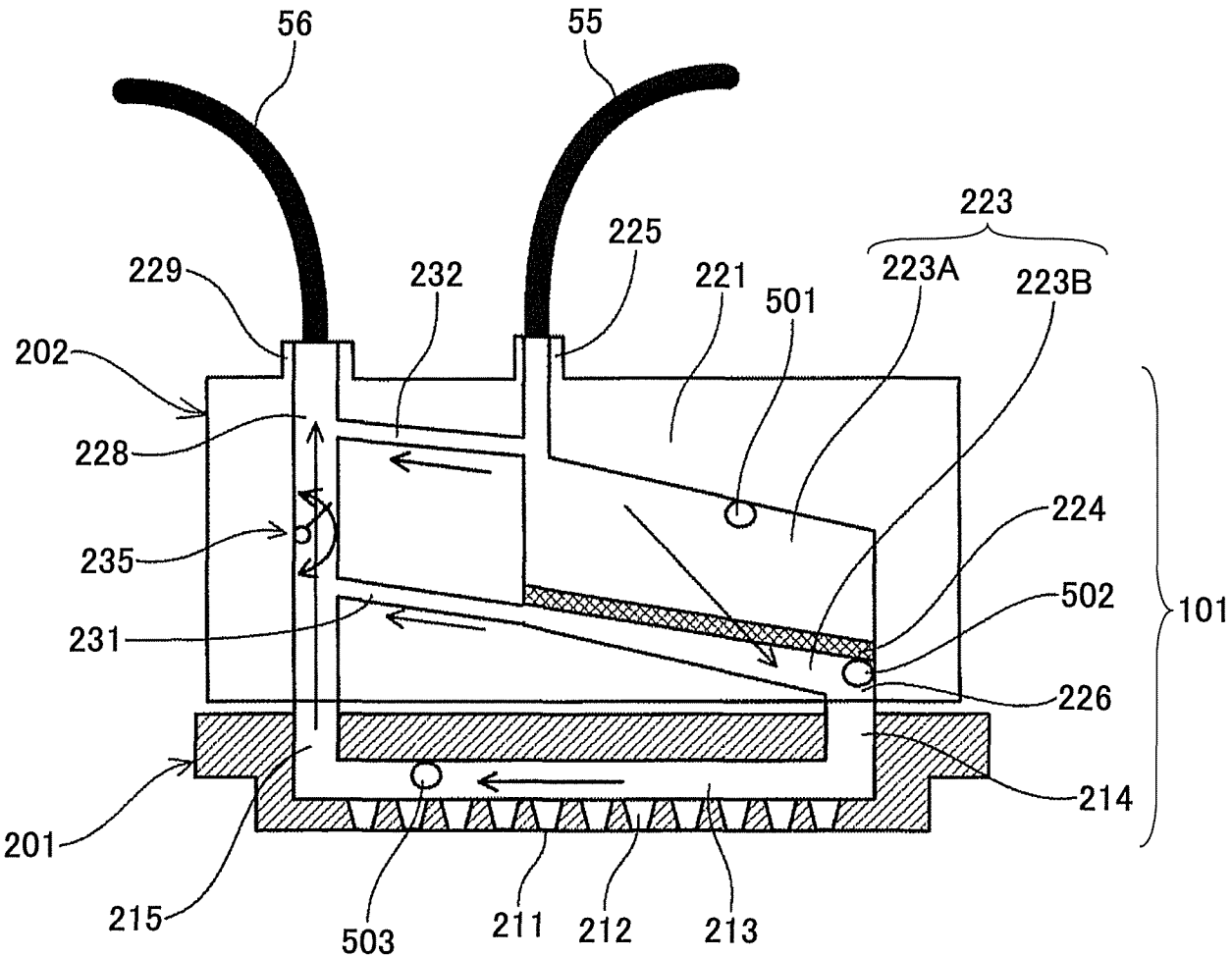
FIG. 9 is a schematic cross-sectional view of a head unit according to a third embodiment of the present invention.

Next, a detailed description is given of the head unit 101 according to a third embodiment of the present invention with reference to FIG. 9. FIG. 9 is a schematic cross-sectional view of the head unit 101 according to the third embodiment.

In the present embodiment, a check valve (impurity flow-in preventing unit) 235 is provided instead of the filter member 234 in the discharge path 228 of the second embodiment. The check valve 235 allows the ink to flow in the discharging direction so that the ink is prevented from flowing in the opposite direction.

According to the above configuration, in a regular jetting operation, the ink, which flows from the filter upstream chamber 223A to the discharge path 228 through the second connection path 232 (ink that has not passed through the filter member 224), is prevented from flowing toward the head 201 through the discharge path 228.

Figure 10B:
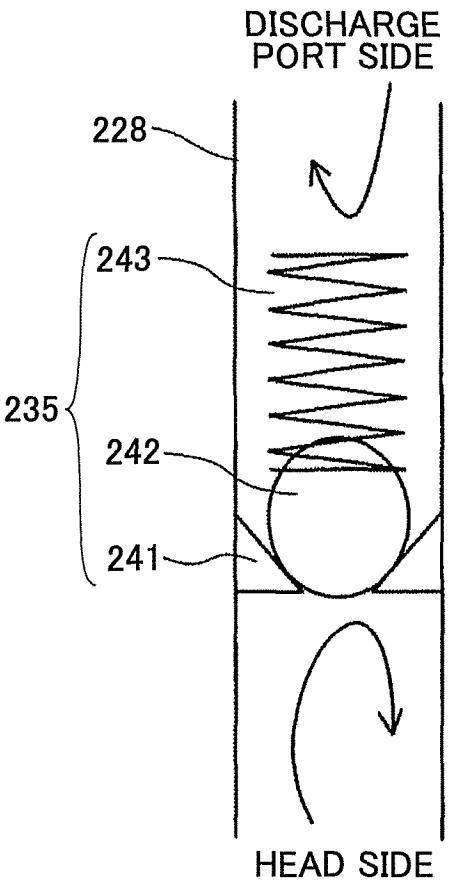
FIGS. 10A and 10B schematically illustrate a first example of a check valve according to the third embodiment.
Figure 10A:
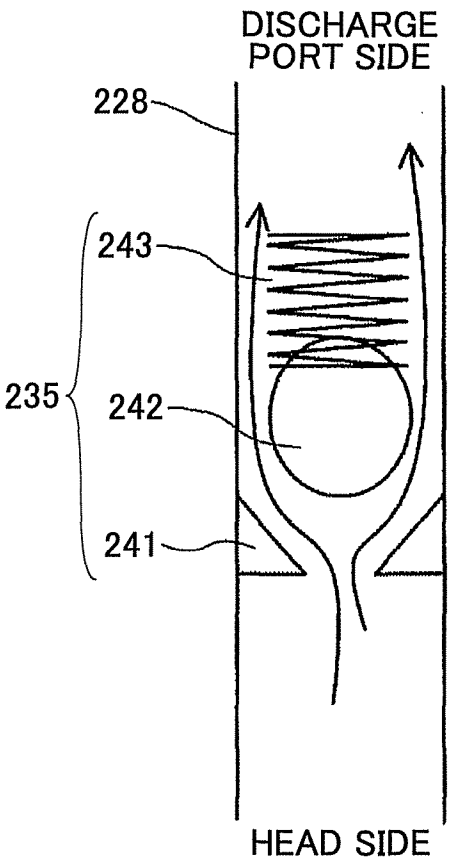

A first example of the check valve 235 is described with reference to FIGS. 10A and 10B. FIGS. 10A and 10B schematically illustrate the check valve 235.

The check valve 235 includes a valve seat 241 provided inside the discharge path 228, a ball 242, and a spring 243 that biases the ball 242 toward the valve seat 241.

During the circulation operation, the flow direction of the discharge path 228 is directed toward the ink discharge port 229 as shown in FIG. 10A (upward as viewed in FIG. 10A). Therefore, the ball 242 is pushed up by the flow of the ink (moves away from the valve seat 241), so that the check valve 235 is open. During a regular jetting operation, the flow direction in the discharge path 228 is directed away from the ink discharge port 229 as shown in FIG. 10B (downward as viewed in FIG. 10B). Therefore, the ball 242 is pushed down by the flow of the ink (comes in contact with the valve seat 241), so that the check valve 235 is closed.

Figure 11A:
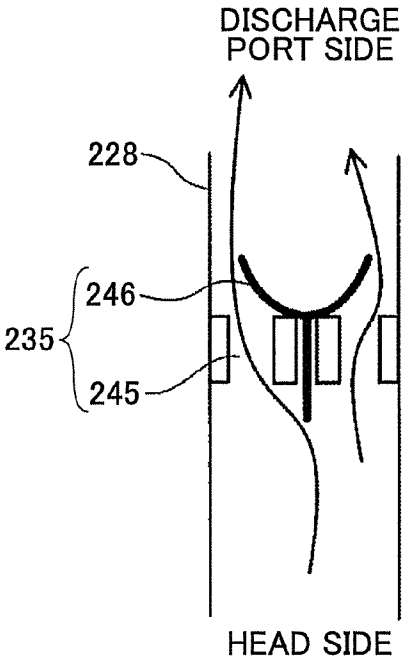
FIGS. 11A through 11D schematically illustrate a second example of the check valve according to the third embodiment.
Figure 11B:
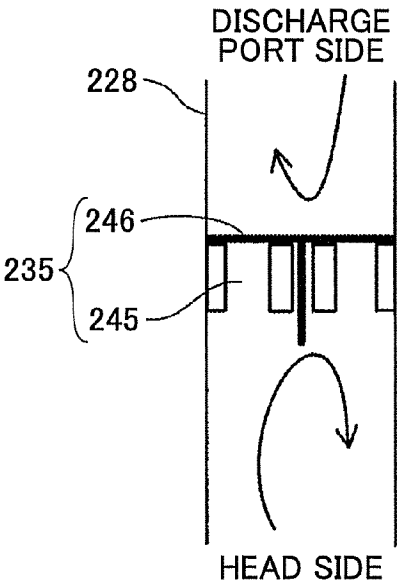
Figure 11C:
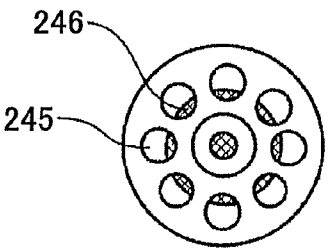
Figure 11D:
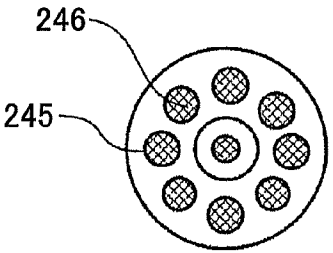

A second example of the check valve 235 is described with reference to FIGS. 11A through 11D. FIGS. 11A through 11D schematically illustrate the check valve 235, where FIGS. 11A and 11B are side views and FIGS. 11C and 11D are bottom views.

The check valve 235 includes plural connection holes 245 formed in the discharge path 228, and an elastic packing member 246 having a mushroom shape for opening and closing the plural connection holes 245.

During the circulation operation, the flow direction in the discharge path 228 is directed toward the ink discharge port 229 as shown in FIG. 11A (upward as viewed in FIG. 11A). Therefore, the packing member 246 is pushed upward by the flow of the ink (opens the connection holes 245), so that the check valve 235 is open. During a regular jetting operation, the flow direction in the discharge path 228 is directed away from the ink discharge port 229 as shown in FIG. 11B (downward as viewed in FIG. 11B). Therefore, the packing member 246 is pushed downward by the flow of the ink (closes the connection holes 245), so that the check valve 235 is closed.

Figure 12:
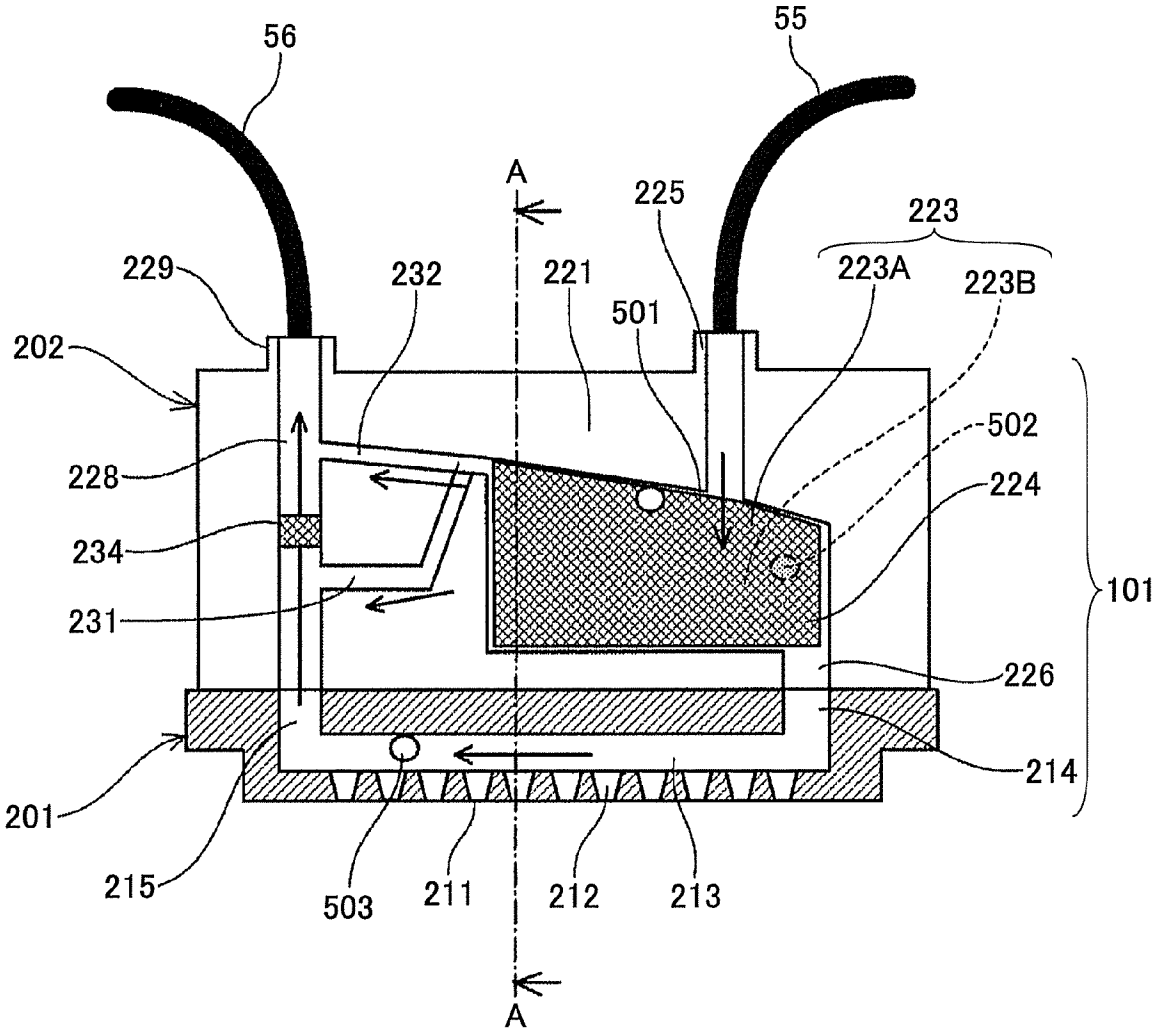
FIG. 12 is a schematic cross-sectional view of a head unit according to a fourth embodiment of the present invention.
Figure 13:
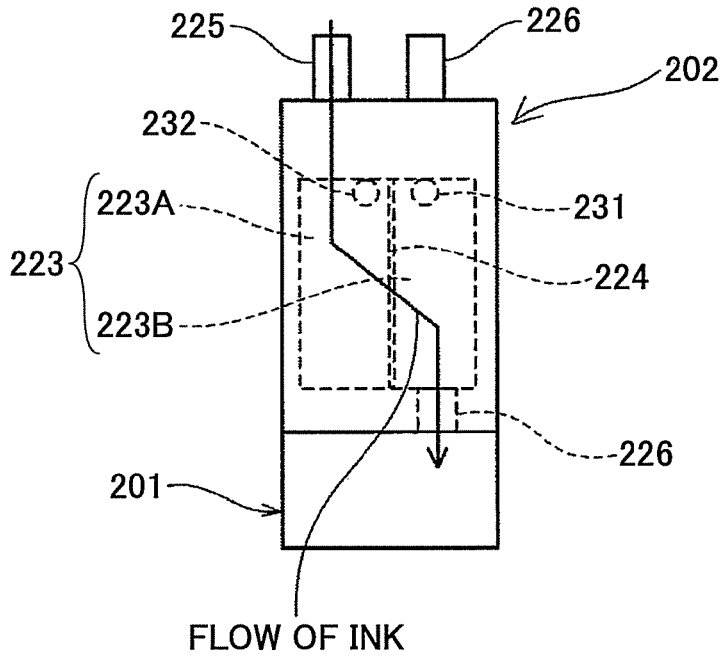
FIG. 13 is a schematic side view of the head unit according to the fourth embodiment.
Figure 14:
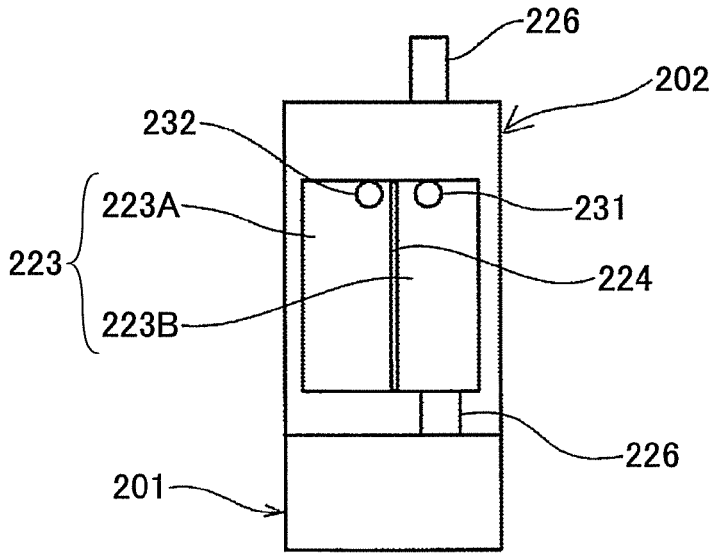
FIG. 14 is a cross sectional view cut along a line A-A in FIG. 12.

Next, a detailed description is given of the head unit 101 according to a fourth embodiment of the present invention with reference to FIGS. 12 through 14. FIG. 12 is a schematic cross-sectional view of the head unit 101 according to the fourth embodiment, FIG. 13 is a schematic side view of the head unit 101 according to the fourth embodiment, and FIG. 14 is a cross sectional view cut along a line A-A in FIG. 12.

In the head unit 101 according to the fourth embodiment, the filter member 224 is disposed in the head tank 202 in a direction extending along the ink supplying direction (vertical direction). The storing unit 223 is formed such that the filter upstream chamber 223A and the filter downstream chamber 223B are aligned in a horizontal direction. An inlet port of the first connection path 231 is provided at the top surface of the filter downstream chamber 223B, and an inlet port of the second connection path 232 is provided at the top surface of the filter upstream chamber 223A. Other configurations are the same as those of the second embodiment.

Accordingly, the effective area of the filter member 224 (area used for removing impurities) can be increased, while the width of the head tank 202 can be decreased, so that the liquid jetting head unit can be made compact.

The above embodiments are applied to a line type image forming apparatus; however, the above embodiments are also applicable to a serial type image forming apparatus.

The present invention is not limited to the specific embodiments described herein, and variations and modifications may be made without departing from the scope of the present invention.

The present application is based on Japanese Priority Patent Application No. 2010-012227, filed on Jan. 22, 2010, the entire contents of which are hereby incorporated herein by reference.

What is claimed is:

1. A liquid jetting head unit comprising:

a head that jets liquid droplets; and a liquid storing tank integrally and directly connected with the head, and provided separately from an external main tank which stores liquid to be supplied to the liquid jetting head unit, the liquid storing tank storing the liquid supplied from the external main tank through a tube to the liquid jetting head unit and supplying the liquid to the head, wherein the head includes a common flow path from which the liquid is supplied to plural liquid chambers connected to plural nozzles that jet the liquid droplets, and the common flow path includes a supply port through which the liquid is supplied into the common flow path and a discharge port through which the liquid is discharged outside, wherein the liquid storing tank integrally and directly connected with the head includes a storage unit that stores the liquid to be supplied to the head, the storage unit being divided into an upstream chamber and a downstream chamber by a filter member, a supply path through which the liquid is supplied to the supply port of the head from the downstream chamber of the storage unit, a discharge path disposed inside of the liquid storing tank, wherein undischarged liquid which flowed through the common flow path and not discharged through the nozzles is returned to the liquid storing tank through the discharge port of the head and then flows through the discharge path and is discharged outside of the liquid jetting head unit, and a first connection path connecting the downstream chamber and the discharge path.

2. The liquid jetting head unit according to claim 1, wherein the first connection path of the liquid storing tank has a fluid resistance that is higher than that of the common flow path of the head.

3. The liquid jetting head unit according to claim 1, wherein the liquid storing tank further includes a second connection path connecting the upstream chamber and the discharge path, wherein the discharge path includes a filter member or a check valve positioned on an upstream side of a connection part in a liquid discharge direction, the connection part being where the discharge path is connected to the second connection path.

4. The liquid jetting head unit according to claim 3, wherein the second connection path of the liquid storing tank has a fluid resistance that is higher than that of the common flow path of the head.

5. A liquid jetting head unit comprising:

a head that jets liquid droplets; and a liquid storing tank integrally and directly connected with the head, and provided separately from an external main tank which stores liquid to be supplied to the liquid jetting head unit, the liquid storing tank storing the liquid supplied from the external main tank through a tube to the liquid jetting head unit and supplying the liquid to the head, wherein the head includes a common flow path from which the liquid is supplied to plural liquid chambers connected to plural nozzles that jet the liquid droplets, and on flow path includes a supply port through which the liquid is supplied into the common flow path and a discharge port through which the liquid is discharged outside, wherein the liquid storing tank integrally and directly connected with the head includes a storage unit that stores the liquid to be supplied to the head, the storage unit being divided into an upstream chamber and a downstream chamber by a filter member, a supply path through which the liquid is supplied to the supply port of the head from the downstream chamber of the storage unit, a discharge path disposed inside of the liquid storing tank, wherein undischarged liquid which flowed through the common flow path and not discharged through the nozzles is returned to the liquid storing tank through the discharge port of the head and then flows through the discharge path and is discharged outside of the liquid jetting head unit, and a first connection path connecting the downstream chamber and the discharge path, and a second connection path connecting the upstream chamber and the discharge path, wherein the discharge path includes a filter member or a check valve positioned in between a first connection part and a second connection part, the first connection part being where the discharge path is connected to the first connection path and the second connection part being where the discharge path is connected to the second connection path.

6. The liquid jetting head unit according to claim 5, wherein the first connection path and the second connection path of the liquid storing tank have a fluid resistance that is higher than that of the common now path of the head.

7. An image forming apparatus comprising the liquid jetting head unit according to claim 1.

8. An image forming apparatus comprising the liquid jetting head unit according to claim 2.

9. An image forming apparatus comprising the liquid jetting head unit according to claim 3.

10. An image forming apparatus comprising the liquid jetting head unit according to claim 4.

11. An image forming apparatus comprising the liquid jetting head unit according to claim 5.

12. An image forming apparatus comprising the liquid jetting head unit according to claim 6.

* * * * *